United States Patent [19]

Walker

[11] Patent Number: 4,640,446

[45] Date of Patent: Feb. 3, 1987

[54] SAFETY GAS CAN WITH PLURAL, NESTABLE DISPENSING MEANS

[76] Inventor: William T. Walker, 28 Tamela Dr., Little Rock, Ark. 72207

[21] Appl. No.: 740,982

[22] Filed: Jun. 4, 1985

[51] Int. Cl.[4] ..... F04F 10/00; B67D 5/06

[52] U.S. Cl. ..... 222/416; 222/464; 222/476; 222/478; 222/530; 222/539; 220/85 SP

[58] Field of Search ..... 222/539, 464, 476, 478, 222/568, 530, 538, 416, 481, 564, 566, 567; 220/85 SP

[56] References Cited

U.S. PATENT DOCUMENTS 1,938,479 12/1933 Baker, Jr. ..... 222/539

3,142,320 7/1964 Olson ..... 222/539

*Primary Examiner*—H. Grant Skaggs

*Assistant Examiner*—Jay I. Alexander

*Attorney, Agent, or Firm*—Leonard Bloom

[57] ABSTRACT

A gas can has first and second removable fuel outlets or dispensing tubes, one of which is nestable within the other during storage. One of the dispensing tubes consistutes a pour spout, while the other dispensing tube constitutes a fuel line coupling member. The can is configured with an ergometric handle for safety and with an internal baffle providing a reserve fuel tank.

9 Claims, 11 Drawing Figures

SAFETY GAS CAN WITH PLURAL, NESTABLE DISPENSING MEANS

FIELD OF THE INVENTION

The present invention relates to fluent material nozzles for containers, and more particularly, to a gasoline can having a dual purpose.

BACKGROUND OF THE INVENTION

When gas cans are used to supply fuel to outboard motors, a fuel line extends from the motor to the can. The fuel line has a coupling member between the motor and the can. A female portion of the coupling member is usually at or near the top of the can, and a fuel line tubing extends into the can.

When gas cans are used to supply fuel for other applications, a pour spout is used at the can opening.

It would be very desirable, therefore, to provide a gas can that would be universal, that is, readily adaptable for use either as a conventional gas can for storage and pouring of gasoline, or as a fuel reservoir for an outboard engine.

SUMMARY OF THE INVENTION

Accordingly, it is an object of the present invention to provide an improved gasoline can having an outboard fuel line coupling member, together with a pour spout, stored in a nested relationship in the can opening for ready and convenient use.

It is another object to provide an improved gasoline can which includes an internal baffle for partitioning the fuel into two areas, thereby providing a reserve tank for an outboard engine.

Preferably, venting to facilitate fuel use occurs along a can top wall, which in one form of the invention is through a hollow handle. A top wall of the can also has an opening spaced from the vent hole through which the fuel passes.

Combined, these features allow a single can to provide fuel conveniently and safely in numerous situations minimizing the hazards associated with fuel transfers.

In accordance with the teachings of the present invention, there is herein disclosed a preferred embodiment thereof, constituting a fluent material storage and dispensing device, including a container having enclosing walls defining an interior within which the material is to be stored. One of the enclosing walls has a portal allowing access to the interior of the container. First and second dispensing means are provided, which together have a single common portal-engaging fastener. The common fastener is deployable on the portal to modify the manner in which the fluent material is dispensed. Means are further provided for nesting the first and second dispensing means, one within the other, and then within the container for storage.

In accordance with the further teachings of the present invention, the first dispensing means is embodied as a fuel line for use with a marine type engine. The dispensing means includes a flange dimensioned to rest on an end wall of the portal. This flange supports a housing having an internal passageway including a threaded portion for coupling to the marine engine. A depending tube is disposed at an end of the passageway remote from the threaded portion. The depending tube in turn is connected to a fuel line hose extending within the interior of the container.

Still further, the second dispensing means is embodied as a fuel nozzle (or pour spout) and includes a flange dimensioned to rest on an end wall of the portal. One face of the flange supports a nozzle having an arcuate, tapering cross section as it extends from the flange and a central passageway. An end of the nozzle remote from the flange has a rolled lip adapted to frictionally receive a sealing cap thereover. A projection on an outer surface of the nozzle and a bore on the cap are dimensioned to receive the projection to store the cap thereon.

Preferably, the device can be embodied as a kit for substitution on an existing, conventional gas can outlet or may constitute a nestable dispensing coupling.

In accordance with the yet still further teachings of the present invention, there is herein illustrated and described, a gasoline can intended to be used for storage or transfer of gasoline as well as a fuel reservoir for an outboard engine. The gasoline can includes a substantially-cylindrical portal having an opening formed therein defined by an uppermost flat annular surface. The portal further has external threads formed thereon and extending below the flat annular surface. A pour spout has an upper annular flange adapted to rest upon the flat annular surface during storage of the pour spout, such that the pour spout extends within the portal and downwardly thereof into the can. A fuel line coupling member has a lower annular flange adapted to rest upon the upper annular flange of the pour spout during storage thereof, such that the fuel line coupling member extends above the portal opening. A fuel line is connected to the fuel line coupling member and depends therefrom, nested within the pour spout and extending into the can. An annular fuel cap has a central opening formed therein for fitting the cap over the fuel line coupling member. The cap is provided with internal threads engaging the external threads on the portal, and the cap bears against the lower annular flange on the fuel line coupling member to retain the fuel line coupling member and the pour spout when the can is used for storage or for transportation of gasoline.

These and other objects of the present invention will become apparent from a reading of the following specification, taken in conjunction with the enclosed drawings.

GENERAL DESCRIPTION OF THE PREFERRED EMBODIMENT

Figure 1:
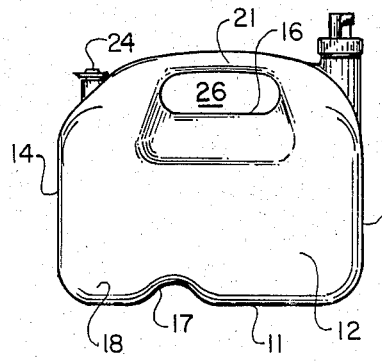
FIG. 1 is a side elevation of a preferred embodiment of a gas can incorporating the teachings of the present invention.
Figure 2:
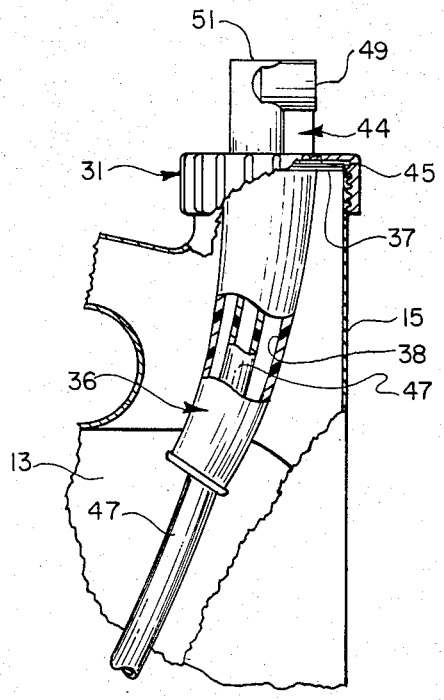
FIG. 2 is a a portion of FIG. 1, drawn to an enlarged scale, and broken away and partially sectioned to illustrate the teachings of the present invention.

With reference to FIG. 1, there is illustrated a gasoline can 10 with which the teachings of the present invention may find more particular utility. It will be appreciated, however, that the teachings of the present invention may be applied to other devices. With this in mind, the can includes a bottom wall 11, side walls 12 and 13 (see FIG. 2), end walls 14 and 15, and a top wall 16 defining an interior for storing and carrying fuel. Preferably, the can is blow molded from a suitable plastic.

The bottom wall 11 and side walls 12 and 13 include an elongated, inverted, "U" shaped indentation 17 extending into the interior of the can. This indentation provides, first, a partition which divides the interior into two portions; and second, an internal baffle which alters turbulence and migration of the fuel when the can is in transit. The indentation 17 therefore provides a "reserve" tank portion 18 (as shown in FIG. 6), minimizes fuel "sloshing", and allows the can 10 to straddle a supporting rib 19 of a boat 20 (see FIG. 10) to keep the can 10 from moving about in rough water.

Figure 7:
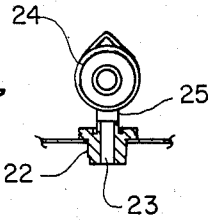
FIG. 7 is a section view taken along lines 7—7 of FIG. 6.
Figure 6:
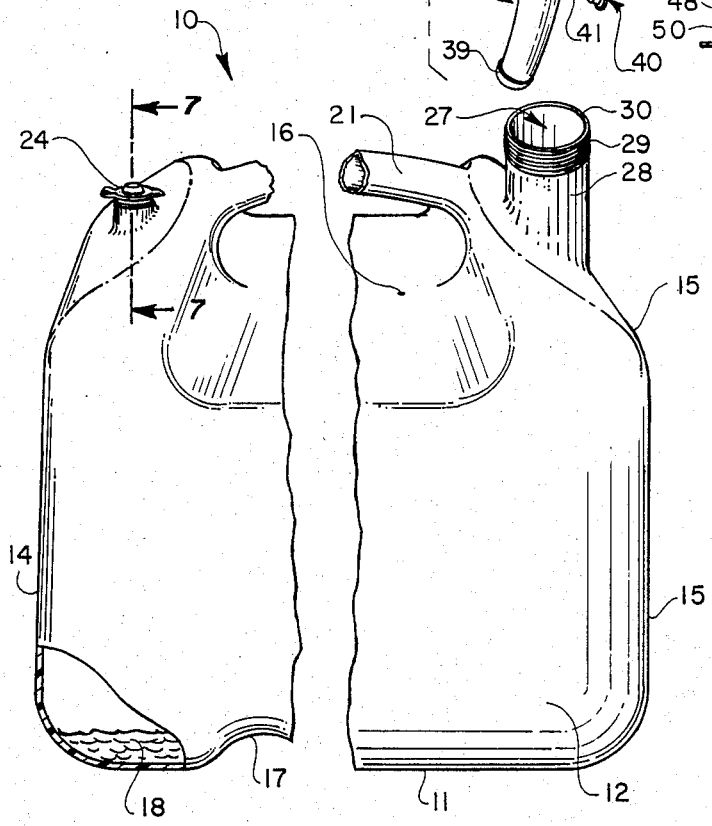
FIG. 6 is a side elevation of the gas can, corresponding substantially to FIG. 1, but drawn to an enlarged scale and with parts broken away and/or removed to show the hollow handle and to further show the reserve tank feature.

With further reference to FIGS. 6 and 7, the top wall 16 has a hollow handle 21 formed integrally therewith. A vent plug 22 is located at one end of the handle 21 and has an aperture 23 to allow air to pass therethrough. The vent plug 22 is connected to a vent cap 24 by a flexible integrally-molded strap 25.

A void 26 below the handle 21 facilitates carrying; the void 26 also allows the can 10 to be lashed down or stored on a hook (not shown).

At the other end of the handle, the fuel passes through a portal opening 27. The portal opening 27 is formed within a substantially-cylindrical stem 28. The stem 28 extends from the top wall 16 and has external threads 29 and an upper flat annular surface 30.

With further reference to FIGS. 2–5, a fuel cap 31 has an annular depending flange provided with internal threads 32 complementary to the external threads 29 of stem 28. The fuel cap 31 has a radially inward shelf 33 and further has a central hole 34. Preferably, the outer surface of the fuel cap 31 is knurled, as at 35, to provide a mechanical advantage in turning the cap.

A pour spout (or fuel nozzle) 36 has an upper annular flange 37 and further has a central passage 38 extending the length of the pour spout. The other end of the pour spout has an outer rolled lip 39 which receives a sealing cap 40. When stored, the sealing cap 40 is attached to the pour spout by a projection 41, which snugly fits into a central dimple 42 on the sealing cap 40. Sealing cap 40 has a peripheral flange 43 dimensioned to frictionally overlie the rolled nozzle lip 39, occluding passage 38. Preferably, the pour spout 36 tapers from its flange 37 to its rolled lip 39 and is somewhat arcuate.

A fuel line coupling member 44 includes a lower annular flange 45 below which is a central, downwardly extending tube 46. A fuel line hose 47 overlies tube 46 and extends substantially to the bottom wall 11 of the can 10. The fuel line coupling member 44 extends up from its flange 45 and defines a substantially "L" shaped passage 48 in fluid communication with hose 47 through tube 46. A horizontal leg 49 of passage 48 has internal threads to receive the male coupling (not shown) which draws fuel to an outboard motor. The coupling member 44 further has an external surface including a rectangular vertical first portion 50 and a cylindrical horizontal second portion 51 adjacent to portion 50, an interior of which defines the passage 48. A blind bore 52 extends into portion 50 to a bottom surface of flange 45 radially spaced from tube 46. Extending a diameter line beyond bore 52 and tube 46 and projecting a vertical plane divides the coupling member 44 into two symmetrical halves. The coupling member 44 is formed from joining these two halves, and the blind bore 52 supports an alignment pin (not shown) on fabrication. The coupling halves may be stamped or injection molded.

The fuel line coupling member 44 constitutes a first dispensing means, while the pour spout (or nozzle) 36 constitutes a second dispensing means. These first and second dispensing means are nested with respect to each other when the gas can is used for storage or transporting of fuel. The first and second dispensing means, respectfully, are used alternately; that is, the first dispensing means is used when the gas can is to be used as a fuel reservoir for an outboard engine, and the second dispensing means (pour spout) is used when the gas can is used for pouring gasoline.

Figure 3A:
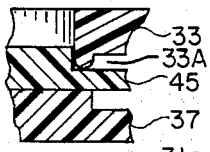
FIG. 3A is an enlarged portion of FIG. 3, showing an annular ridge on the fuel cap to clamp against the flange on the fuel line coupling member.
Figure 4:
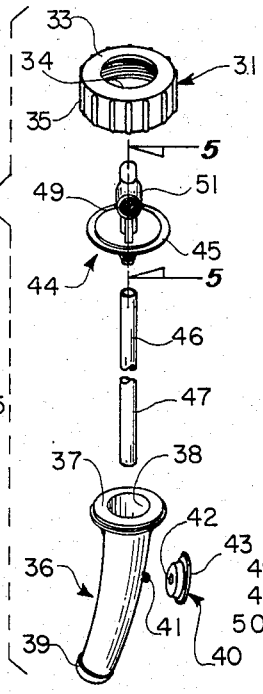
FIG. 4 is an exploded perspective of the components shown in FIGS. 2 and 3.
Figure 3:
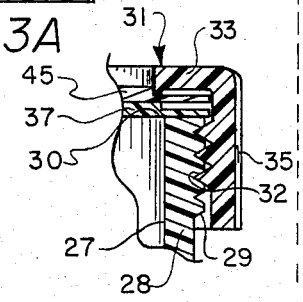
FIG. 3 is an enlarged portion of FIG. 2 with parts broken away, to show the nesting of the flanges formed on the fuel line coupling member and the pour spout, respectively, and their retention by a knurled fuel cap.
Figure 5:
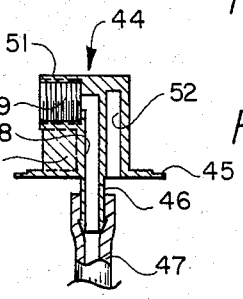
FIG. 5 is a section view taken along lines 5—5 of FIG. 4.

In storage, as shown in FIGS. 3 and 3A, the upper annular flange 37 of the pour spout 36 rests upon the flat annular surface 30 of the portal opening 27. The lower annular flange 45 of the fuel line coupling member 44 rests upon the upper annular flange 37 of the pour spout 36. The internal threads 32 of the knurled fuel cap 31 engage the external threads 29 in the stem 28. The shelf 33 on the knurled fuel cap 31 has an annular ridge 33A which engages and bears against the flange 45 (and hence the flange 37) to securely retain the pour spout 36 and the fuel line coupling member 44, respectively, in their nested relationship to one another during storage or transportation of the gasoline can 10. The fuel line coupling member 44 extends upwardly through the hole 34 in the knurled fuel cap 31, as shown more clearly in FIG. 2.

Figure 10:
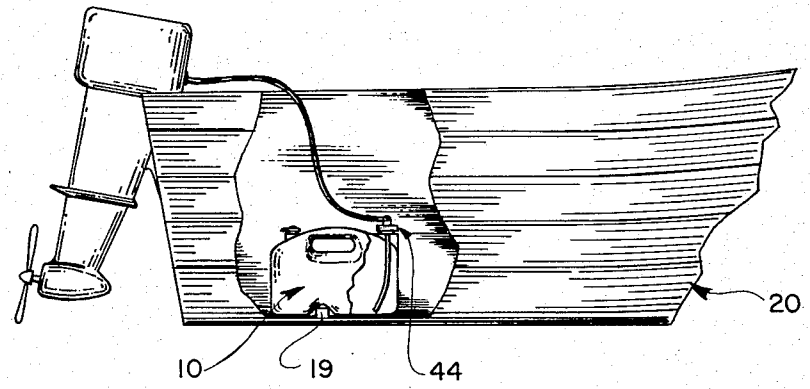
FIG. 10 shows the embodiment of FIG. 1 used as a fuel reservoir for an outboard engine.
Figure 9:
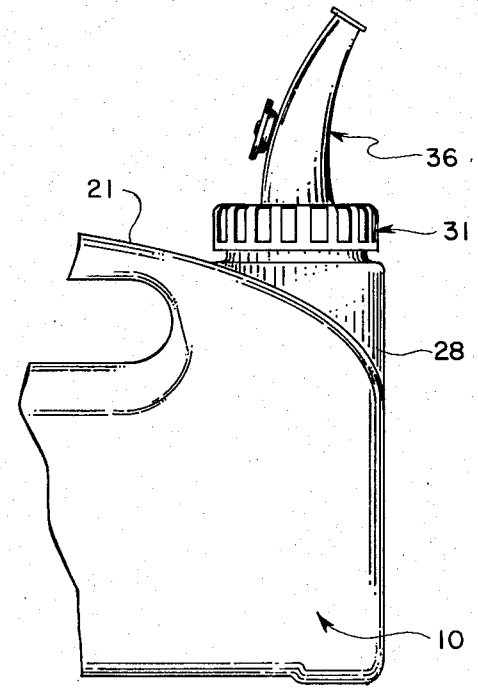
FIG. 9 shows the embodiment of FIG. 1 used as a gas can for transferring fuel.

When the gasoline can 10 is used for transferring or dispensing fuel, the fuel line coupling member 44 is removed, and the pour spout 36 is secured to the portal opening 27 by the knurled fuel cap 31 as shown in FIG. 9. When the gasoline can 10 is used as a fuel reservoir for an outboard motor in a boat 20, as shown in FIG. 10, the pour spout 36 is removed; and the knurled fuel cap 31 securely retains the fuel line coupling member 44.

Figure 8:
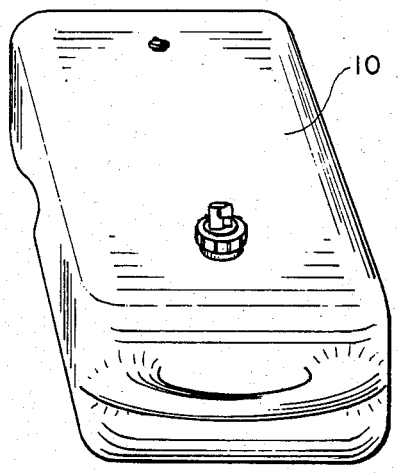
FIG. 8 is a perspective view of a second embodiment.

FIG. 8 shows an alternate embodiment, wherein the gasoline can 10 is substantially flat, rather than upright, as shown in FIG. 1.

Obviously, many modifications may be made without departing from the basic spirit of the present invention. Accordingly, within the scope of the appended claims, the invention may be practiced other than specifically disclosed herein.

What is claimed is:

1. A fluent material storage and dispensing device, comprising in combination:

a container having enclosing walls defining an interior within which the material is to be stored, one of the enclosing walls having a portal allowing access to the interior of said container, first and second open tubular dispensing means together having a single common portal-engaging fastener, wherein said common fastener is deployable on said portal to modify the manner in which the fluent material is dispensed, wherein said first dispensing means comprises a tube disposed inside said second dispensing means and extending therebelow to substantially reach the bottom of the container, and wherein said second dispensing means comprises a pour spout jacketing a portion of said first dispensing means, and means for nesting said first and second dispensing means, one within the other, and then within said container for storage.

2. A fluent material storage and dispensing device, comprising in combination:

a container having enclosing walls defining an interior within which the material is to be stored, one of the enclosing walls having a portal allowing access to the interior of said container, first and second dispensing means together having a single common portal-engaging fastener, wherein said common fastener is deployable on said portal to modify the manner in which the fluent material is dispensed, and means for nesting said first and second dispensing means, one within the other, and then within said container for storage, wherein said first dispensing means is embodied as a fuel line for use with a marine type engine and includes:

a flange dimensioned to rest on an end wall of said portal, said flange supporting a housing having an internal passageway including a threaded portion for coupling to the marine engine and a depending tube at an end of said passageway remote from said threaded portion, said depending tube in turn connected to a fuel line hose extending within the interior of said container.

3. The device of claim 2 wherein said second dispensing means is embodied as a fuel nozzle including:

a flange dimensioned to rest on an end wall of said portal, one face of said flange supporting a nozzle having an arcuate, tapering cross section as it extends from the flange and a central passageway, an end of said nozzle remote from said flange having a rolled lip adapted to frictionally receive a sealing cap thereover, a projection on an outer surface of said nozzle and a bore on said cap dimensioned to receive said projection to store said cap thereon.

4. In a dispensing coupling:

an annular stem with a threaded portion circumscribing said annular stem and including a peripheral surface on an end wall of said stem, an annular barrel cap having an interior thread dimensioned to threadedly engage said threaded stem and having a radially inwardly extending shelf overlying said stem surface, an innermost portion of said shelf defining a substantially circular void, first and second open tubular dispensing means each having outlets of different cross-section dimension but both having a radially extending lip coextensive with an external diameter of said stem placed between said cap shelf and said stem surface such that one said outlet nests within the other said outlet concentrically, wherein said first dispensing means comprises a tube disposed inside said second dispensing means and extending therebelow to substantially reach the bottom of the container, and wherein said second dispensing means comprises a pour spout jacketing a portion of said first dispensing means.

5. In a dispensing coupling:

an annular stem with a threaded portion circumscribing said annular stem and including a peripheral surface on an end wall of said stem, an annular barrel cap having an interior thread dimensioned to threadedly engage said threaded stem and having a radially inwardly extending shelf overlying said stem surface, an innermost portion of said shelf defining a substantially circular void, first and second dispensing means each having outlets of different cross-sectional dimension but both having a radially extending lip coextensive with an external diameter of said stem placed between said cap shelf and said stem surface such that one said outlet nests within the other said outlet concentrically, wherein said first dispensing means is embodied as a fuel line for use with a marine type engine and includes:

a flange dimensioned to rest on an end wall of said portal, said flange supporting a housing having an internal passageway including a threaded portion for coupling to the marine engine and a depending tube at an end of said passageway remote from said threaded portion, said depending tube in turn connected to a fuel line hose extending within the interior of said container.

6. The dispensing coupling of claim 5, wherein said second dispensing means is embodied as a fuel nozzle including:

a flange dimensioned to rest on an end wall of said portal, one face of said flange supporting a nozzle having an arcuate, tapering cross section as it extends from the flange and a central passageway, an end of said nozzle remote from said flange having a rolled lip adapted to frictionally receive a sealing cap thereover, a projection on an outer surface of said nozzle and a bore on said cap dimensioned to receive said projection to store said cap thereon.

7. A kit with means for variably altering the flow rate of fluent material and nestable storage means for said flow altering means comprising in combination:

first and second tubular dispensing means, each dispensing means having a first and second open end, said second dispensing means having a greater cross section than said first dispensing means such that said second dispensing means can be slid over said first dispensing means concentrically, said greater tubular second dispensing means having a radially extending end flange adapted to abut against a similar diameter flange on said inner first tubular dispensing means, and a coupling means adapted to engage either or both flanges, respectively, for use or storage.

8. A gasoline can intended to be used for storage of gasoline as well as a fuel reservoir for an outboard engine, comprising a substantially prismatic container including side walls, end walls and a bottom wall, and further including a top portion having a portal on one end thereof and further having a vent opening on the opposite end thereof, a hollow handle between the portal and the vent opening and, with the top portion, forming a hand grip for the can, a pour spout, means for coupling the pour spout to the portal when the can is used for dispensing gasoline, a fuel line tube, means for coupling the fuel line tube to the portal for siphoning gasoline when the can is used as a fuel reservoir for an outboard engine, means for nesting the fuel line tube within the pour spout, and the pour spout within the portal in the can, during storage or transporting of the can, and the bottom wall having an upwardly-projecting indentation formed therein and extending within the can to form an internal partition, thereby forming a reserve fuel tank when the can is used as a fuel reservoir for an outboard engine.

9. In a gasoline can intended to be used for storage of gasoline as well as a fuel reservoir for an outboard engine, the combination of a substantially-cylindrical portal having an opening formed therein defined by an uppermost flat annular surface, the portal further having external threads formed thereon and extending below the flat annular surface, a pour spout having an upper annular flange adapted to rest upon the flat annular surface during storage of the pour spout, such that the pour spout extends within the portal and downwardly thereof into the can, a fuel line coupling member having a lower annular flange adapted to rest upon the upper annular flange of the pour spout during storage thereof, such that the fuel line coupling member extends above the portal opening, a fuel line connected to the fuel line coupling member and depending therefrom, the fuel line being nested within the pour spout and extending into the can, and an annular fuel cap having a central opening formed therein for fitting the cap over the fuel line coupling member, the fuel cap being provided with internal threads engaging the external threads on the portal, and the fuel cap bearing against the lower annular flange on the fuel line coupling member to retain the fuel line coupling member and the pour spout when the can is used for storage or for transportation of gasoline.

* * * * *